US006679239B1

(12) United States Patent
Shultz et al.

(10) Patent No.: US 6,679,239 B1
(45) Date of Patent: Jan. 20, 2004

(54) REMOTELY ACTUATED APPARATUS FOR THROWING AN OBJECT

(76) Inventors: Michael W. Shultz, 315 Struthers Liberty Rd., Campbell, OH (US) 44405; Christopher P. Eash, 435 Pennsylvania Ave., McDonald, OH (US) 44437; Kevin A. Shar, 101 Hood Dr., Canfield, OH (US) 44406

( * ) Notice: Subject to any disclaimer, the term of this patent is extended or adjusted under 35 U.S.C. 154(b) by 0 days.

(21) Appl. No.: 10/436,819

(22) Filed: May 13, 2003

(51) Int. Cl.[7] ..... F41B 3/03

(52) U.S. Cl. ..... 124/16; 124/17; 124/32; 124/34; 124/36

(58) Field of Search ..... 124/16, 17, 32, 124/34, 36

(56) References Cited

U.S. PATENT DOCUMENTS

| | | | | |
|---|---|---|---|---|
| 129,105 | A | | 7/1872 | Collier |
| 2,308,037 | A | | 1/1943 | Abadjieff |
| 3,611,996 | A | * | 10/1971 | Wegner et al. |
| 3,665,452 | A | | 5/1972 | MacCreadie |
| 3,770,981 | A | * | 11/1973 | Nelsen |
| 3,777,733 | A | * | 12/1973 | Mitchell |
| 3,794,325 | A | * | 2/1974 | Stender |
| 3,892,217 | A | * | 7/1975 | Raty |
| 3,951,125 | A | | 4/1976 | Dixon |
| 3,977,386 | A | | 8/1976 | Meyer |
| 4,596,230 | A | | 6/1986 | Griffith |
| 5,084,696 | A | | 1/1992 | Guscott et al. |
| 5,130,955 | A | | 7/1992 | Luerker et al. |
| 5,181,009 | A | | 1/1993 | Perona |
| 5,224,701 | A | | 7/1993 | Sciarrillo et al. |
| 5,294,111 | A | | 3/1994 | Bloch |
| 5,851,012 | A | | 12/1998 | Langieri, Jr. et al. |
| 5,861,808 | A | | 1/1999 | Lehmann et al. |
| 5,912,864 | A | | 6/1999 | Maurer |
| 6,244,260 | B1 | * | 6/2001 | Ragoza et al. |
| 6,424,598 | B1 | | 7/2002 | Shultz |

* cited by examiner

*Primary Examiner*—John A. Ricci
(74) *Attorney, Agent, or Firm*—Robert J. Herberger

(57) ABSTRACT

Apparatus for throwing a football includes a pivoting arm supporting the ball and a spring, which preloads the arm to pivot upward and release the football. The arm is rotated manually to a ready-to-throw preloaded position, where the arm is latched by a plunger and released to pivot and launch the ball in response to a command signal transmitted at a distance from the apparatus by a player awaiting the ball. The command signal causes an electric power source to energize a solenoid, whereby the plunger releases the arm, the spring pivots the throwing arm forward, and the ball travels an airborne path to the player.

21 Claims, 7 Drawing Sheets

REMOTELY ACTUATED APPARATUS FOR THROWING AN OBJECT

BACKGROUND OF THE INVENTION

1. Field of the Invention

This invention relates to machines for throwing objects, more particularly to machines that throw a ball in response to a command signal.

2. Description of the Prior Art

Various devices for throwing a game ball under practice conditions are known. Some of these devices, particularly those for throwing footballs, impart to the ball spin, tumble and wobble in order to simulate the ball's motion when passed, kicked or punted by players under game conditions.

U.S. Pat. No. 5,851,012 describes a game apparatus having a spring-loaded lever for throwing a round ball toward an inanimate, moving target. The lever causes the ball to spin while propelled toward the target, which moves along a circular path. The apparatus directs the ball away from the user and lever toward the target when the user manually releases the lever. There is no latch for holding the lever mechanically in a preloaded condition, and no delay period is provided after arming the lever and before its release.

Other devices of this type, especially those that throw a football, attempt to impart various kinds of rotational movement to the ball, such as spiral rotation about a longitudinal axis or end-over-end rotation about a transverse axis. For example, U.S. Pat. No. 5,224,701 describes a machine for launching a football along an airborne path using a pneumatically actuated piston to accelerate a receptacle that holds the football before launch. A threaded shaft, located between the piston and receptacle, is driven through a threaded nut to impart rapid spin to the football as it is launched.

The machine described in U.S. Pat. No. 4,596,230 has a reciprocating plunger for developing a force required to accelerate the football, a chute for arranging the football in a kick position or pass position, and rotating wheels that engage the surface of the football to impart varying degrees of spin and wobble, or end-over-end tumbling to the ball. A rotating turret holds several footballs that are sequentially fed to the reciprocating plunger. The ball is ejected with preselected spin and wobble by two variably inclined wheels rotating in opposite directions.

Various attempts have been made to provide such machines with a latching device that holds the machine ready to release the football into its airborne path. U.S. Pat. No. 3,951,125 describes a machine having a throwing arm, which is latched in a ready-to-throw position. The throwing arm is released in response to action of a mechanical timer that provides a variable delay after arming the device and until its release. After the variable delay mechanism is set, the operator has substantially no further control over the release of the football, which is propelled by two highly loaded tension springs applying a substantial force to the throwing arm.

The football throwing apparatus described in U.S. Pat. No. 3,977,386 also provides a mechanical delay for a predetermined period that allows the user to move into position to receive the football after setting a delay timer. The operator has substantially no control over release of the football after the mechanical delay mechanism is set.

None of these machines provides a technique or apparatus as the instant invention for releasing the throwing arm upon receiving a command signal transmitted remotely by a user, who is positioned and prepared to receive the ball from the machine.

SUMMARY OF THE INVENTION

It is preferable that a football delivery apparatus provide a reliable period of delay after arming a preloaded throwing arm and placing a football on the arm without need for further manual manipulation of the machine until after the arm is released.

It is an advantage of the present invention that the delivery apparatus releases a football to a waiting player in response to a signal transmitted remotely by the player to the throwing apparatus. The command signal is produced in response to manual operation of a transmitter preferably by the player, thereby emulating an intentional command given by the player prior to release of the ball during a game.

It is a further advantage of the present invention that the command signal that causes the release of a throwing arm not be affected inadvertently by a command signal caused by radiation from sunlight, heat, artificial illumination or a command signal produced by a device other than the signal intended by the user to release the arm and throw the football. In a preferred embodiment, the command signal is a radio frequency signal, but it may also be a signal in the infrared spectrum, an electromagnetic signal or a microwave signal.

In realizing these advantages an apparatus according to the present invention includes a pivotally mounted arm supporting the object, the arm having an preloaded position at which the arm is elastically biased to eject the object from the apparatus, a latch continually tending to engage and hold the arm in the preloaded position and able, in response to a command signal, to disengage and release the arm from the preloaded position, a transmitter producing a command signal, and a controller having a receiver adapted to receive the command signal and produce in response to the command signal an actuation signal that disengages the latch and releases the arm. Preferably the object is ejected by being thrown by the arm in an airborne path toward a player awaiting a football thrown from the apparatus.

BRIEF DESCRIPTION OF THE DRAWINGS

It is to be understood, however, that the drawings are designed for the purpose of illustration only and not as a definition of the limits of the instant invention, for which reference should be made to the claims appended hereto. Other features, objects and advantages of this invention will become clear from the following more detailed description made with reference to the drawings in which:

DETAILED DESCRIPTION

Figure 1:
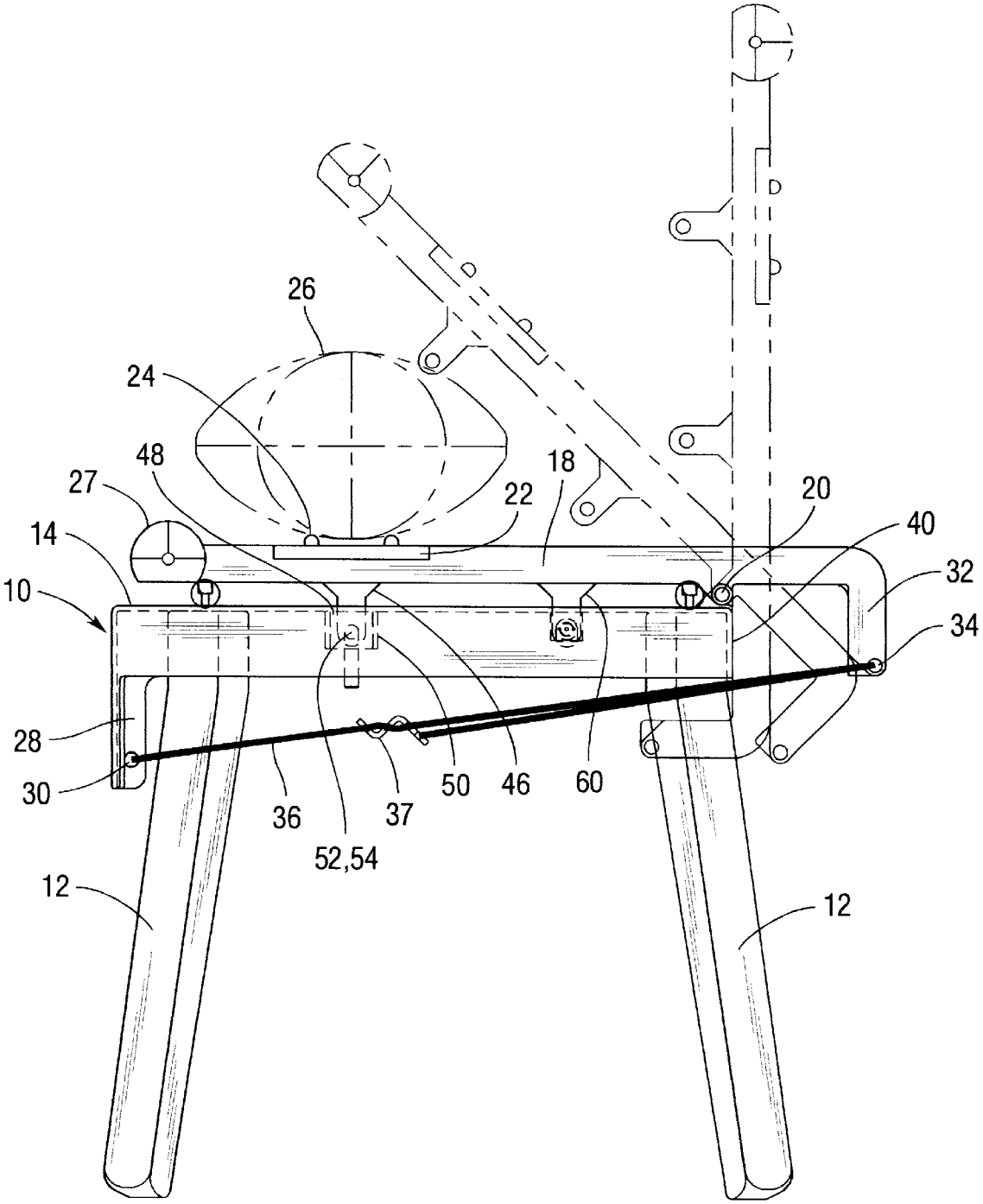
FIG. 1 is a side elevational view of the delivery apparatus according to the present invention.
Figure 2:
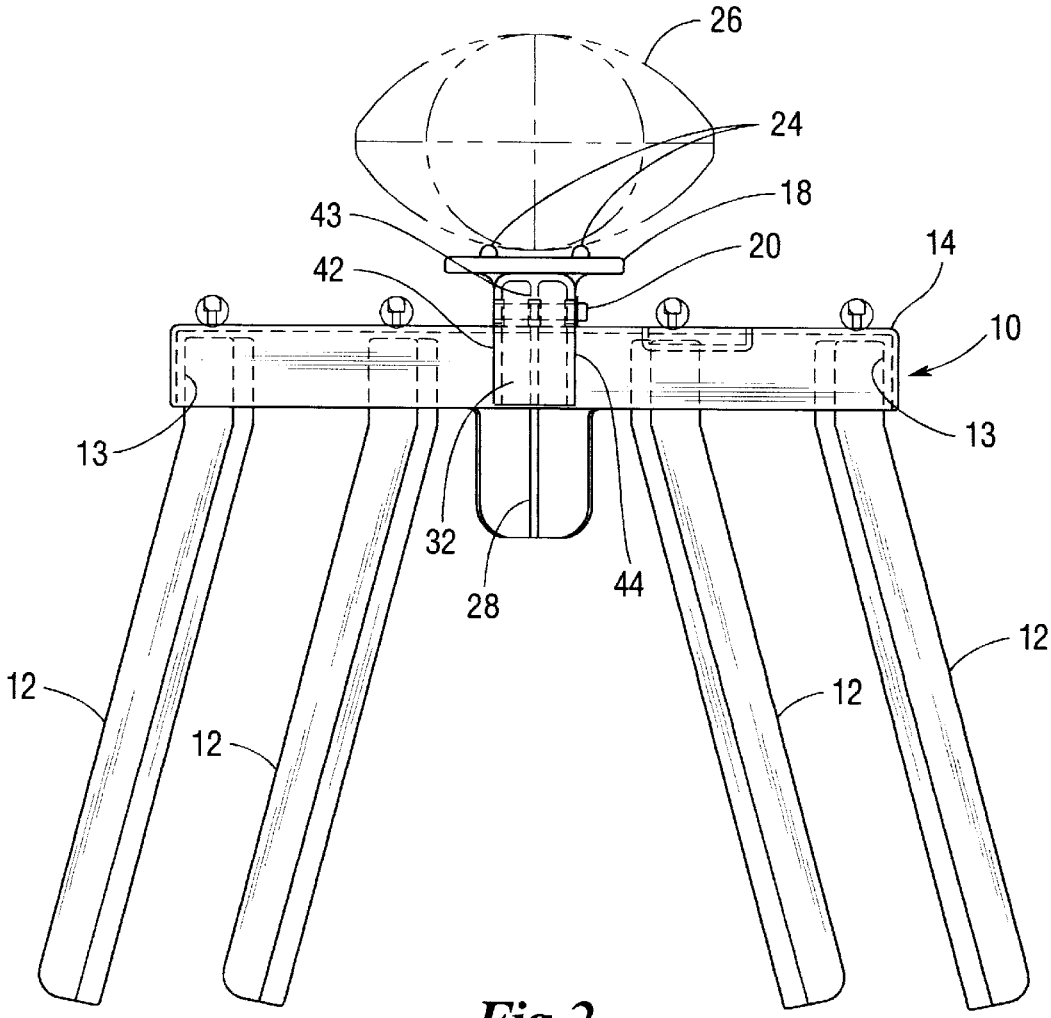
FIG. 2 is a front elevational view of the apparatus of FIG. 1.
Figure 3:
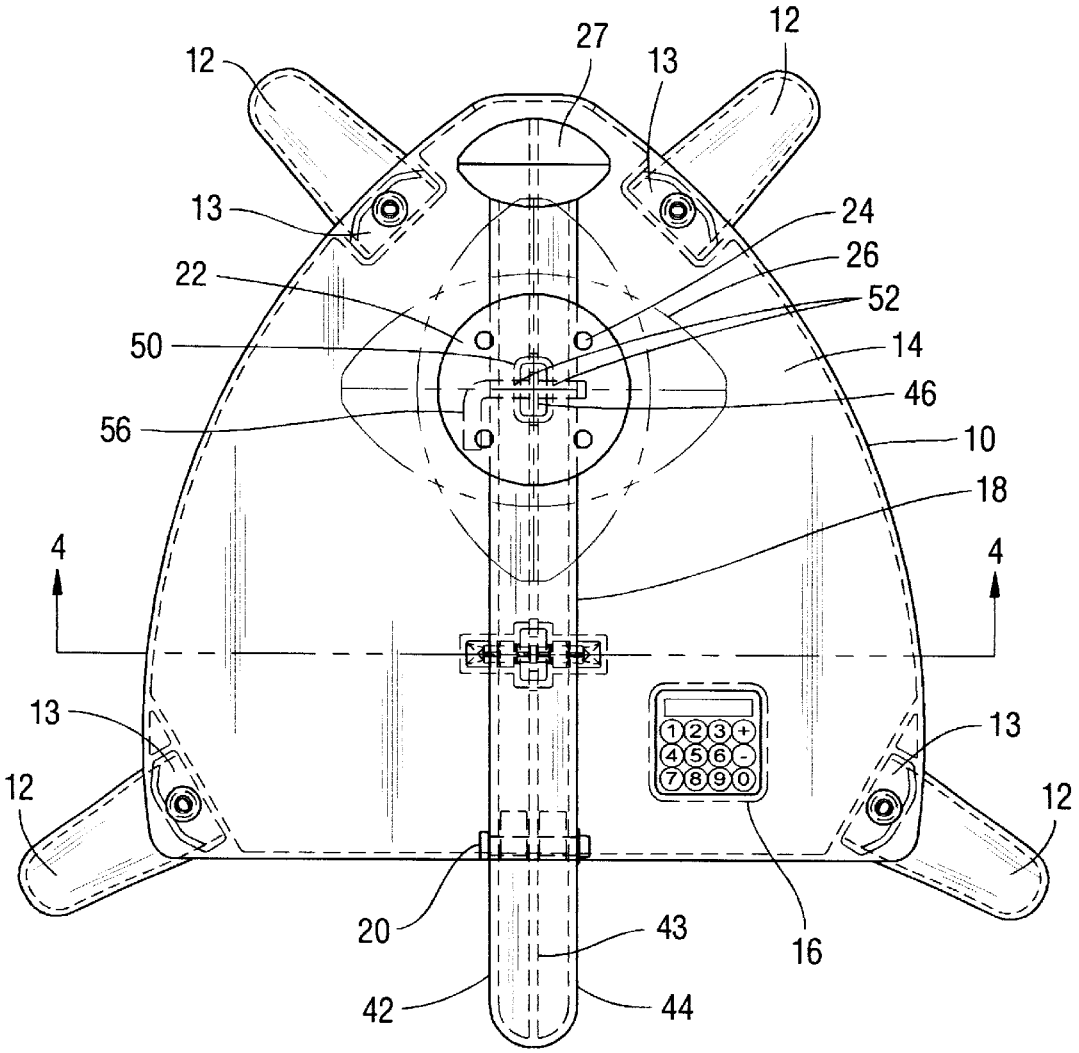
FIG. 3 is a plan view of the apparatus of FIG. 1.

An apparatus for use during football practice to throw a football to a quarterback standing behind the device at a distance approximating the "shotgun" position is shown in FIGS. 1, 2, and 3. The machine includes a base 10, supported above the field surface on legs 12 having rounded lower ends. The legs are removably fitted into pockets 13 formed on the lower surface of the base. The base provides a planer upper surface 14, on which an electronic module 16 containing a controller and numbered keypad is supported.

A throwing arm 18 is hinged on the base at a pivot pin 20 for pivoting movement between the preloaded position shown in FIG. 1, where the throwing arm is substantially aligned with the upper surface 14, and the position at the other extreme of its travel, where the throwing arm is in a substantially vertical position. Preferably pivot pin 20 is not removable from the base. The throwing arm carries a cradle 22 having four projections 24 for supporting a football or another object 26 before the arm is actuated. The arm is lowered to the horizontal position through use of a handle 27, preferably having the shape of a football.

The forward end of the base carries a flange 28, which is extends downward from the upper surface 14 and provides a connection port such a hole 30 through its thickness. At the end opposite the location of flange 28, the throwing arm 18 is formed with a flange 32, directed downward and perpendicular to flange 28 when the arm 18 is horizontal. Flange 32 is formed with a second connection port, a hole 34 through its thickness. Of course the first and second connection ports may also be extending tabs. A flexible elastic member 36, such as a tension spring or heavy-duty elastic cord, like a Bungee cord, engages the base at hole 30 and the throwing arm at hole 34. Preferably a tension adjuster 37 can adjust the length of the elastic member 36 and the biasing force it develops. When the throwing arm is horizontal, a tension force developed in the elastic member 36 is poised to cause the throwing arm 18 to pivot rapidly about pin 20 to the vertical position of FIG. 1 and to throw the football to an awaiting player. Contact between the lower surface of the throwing arm and the forward edge of the base limits the extent of pivoting movement of the throwing arm about pin 20.

Alternatively the throwing arm 18 can be bent elastically when the arm is lowered to the horizontal position, the arm developing upward resilient force that pivots the throwing arm and launches the football to the player. In this case, the elastic member 36 can be eliminated.

The lower surface of the throwing arm 18 is formed with multiple ribs 42, 43, 44, which extend along the length of the throwing arm and are spaced mutually across the width of the throwing arm. FIGS. 1 and 3 show the center rib 43 has a local projection 46, which extends through an opening 48 formed on the upper surface 14 of the base 10, permitting the projection 46 to extend into a space surrounded by a rectangular flange 50 located on the lower surface of the base 10. The lateral sides of the flange 50 are formed with holes 52, which are aligned mutually and with a hole 54 formed on projection 46. When the throwing arm is to be stowed, the elastic element 36 is preferably removed or it can be left in place, and the throwing arm is pivoted about pin 20 to the horizontal position of FIG. 1. Then a safety storage pin 56 is inserted through the aligned holes 52, 54 in the flange 50 and projection 46. This action secures the throwing arm in a folded, compact position.

Figure 4:
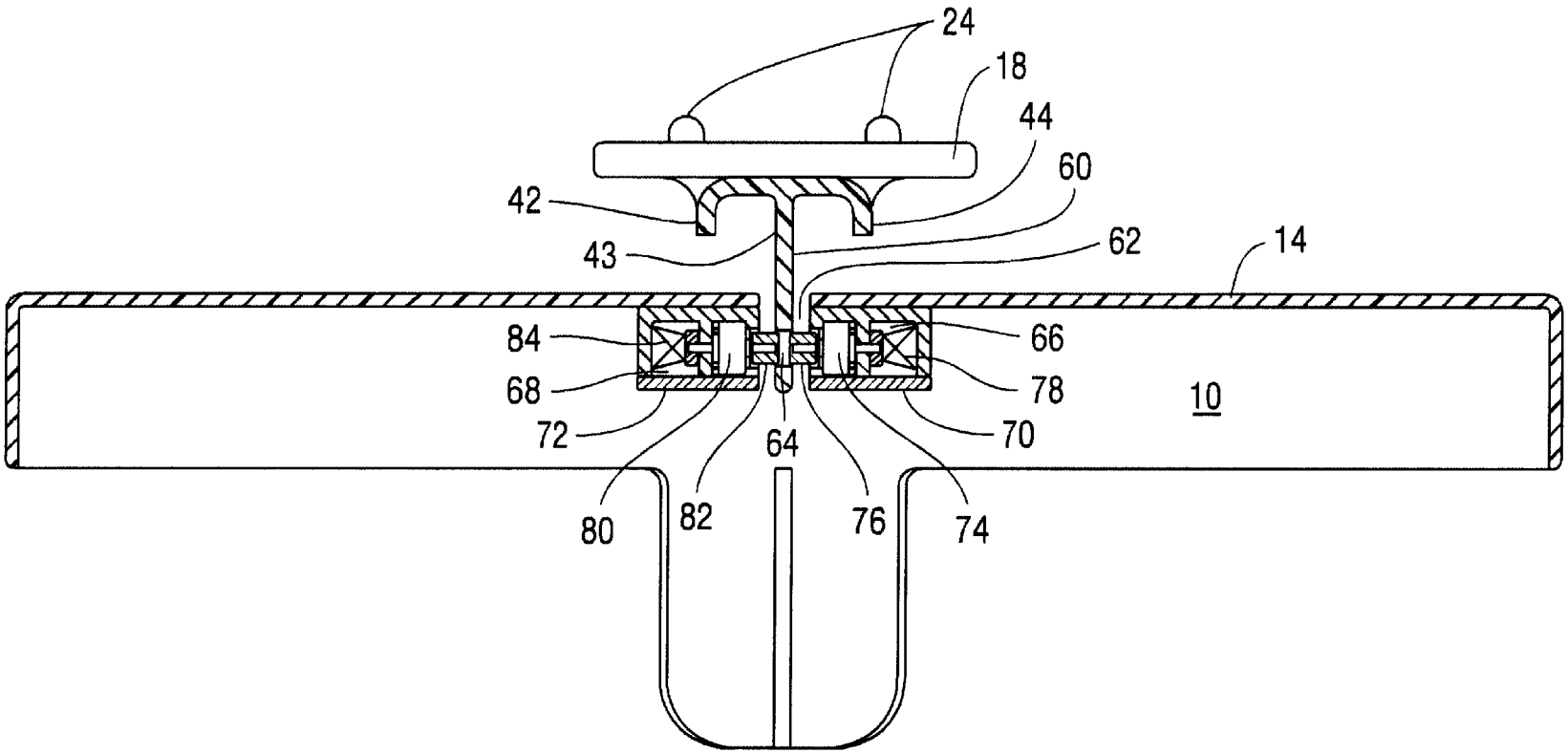
FIG. 4 is a cross sectional view taken at plane 4—4 of FIG. 3.
Figure 5:
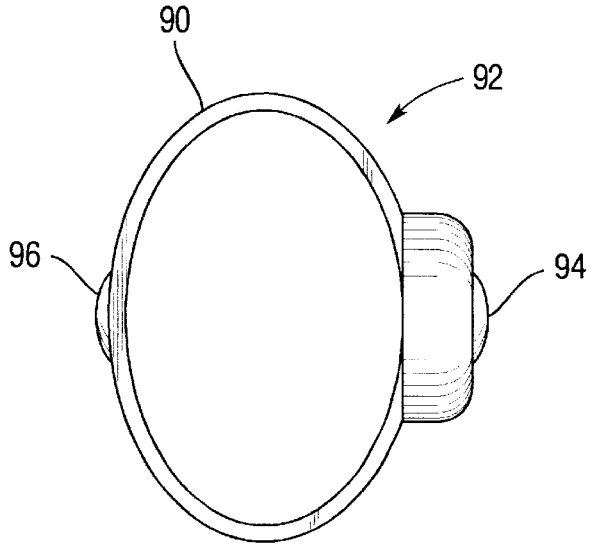
FIG. 5 is a top view of a band having a transmitter and command buttons.
Figure 6:
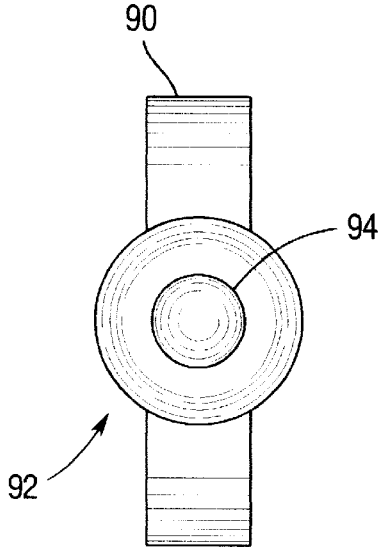
FIG. 6 is a front view of the band of FIG. 5.

Referring to FIG. 4, the center rib 43 of the throwing arm 18 includes a latch tab 60, which extends downward from the lower surface of the throwing arm through an opening 62 formed on the surface 14 of the base 10. Tab 60 has a hole 64 located near its lower end and extending through its thickness.

Located on the lower surface of base 10 and aligned with the opening 64 on the latch tab 60 is a latching mechanism located in a right-hand chamber and a left-hand chamber 66, 68, each chamber enclosed by a cover plate 70, 72, respectively. Located in chamber 66 are an electrical solenoid 74 and a latching plunger 76, which moves laterally into and out of engagement with the hole 64 of latch tab 60. A compression spring 78, also located in chamber 66, continually urges plunger 66 toward engagement with tab 60.

Similarly, chamber housing 68 includes an electrical solenoid 80, which actuates a latch plunger 82 to disengage the hole of latch tab 60, and a compression spring 84, which continually urging the plunger 82 into engagement with the hole 64 in latch tab 60. When the throwing arm 18 is pivoted to the horizontal position in preparation to throw a football supported on the cradle 22, the latch plungers are pressed inward by the springs 78, 84 to engage the latch tab 60 and prevent the elastic member 36 from pivoting the arm upward until a command signal is produced.

The latching mechanism is activated electronically from a distance of about 5 to 10 feet from the apparatus. A band 90 is attached to the wrist of the player who is to receive the ball, either by a strap, or preferably by a interlocking connection to mating VELCRO material worn on the player's wrist.

The wristband 90 carries a transmitter module 92 having an arming button 94 preferably worn on the outside portion of the wrist, an electric power source 128 such as a dry cell battery, transmitter output unit and switch. A trigger button 96, carried on the band 90 opposite the location of the arming button 94, is used to release the arm from the latch plungers 76, 82, thereby allowing the football to be thrown by the machine to a player located behind the delivery apparatus.

After the arm is preloaded and latched, the invention provides a technique to avoid accidental injury to a person who might inadvertently enter the space between the arm and the airborne path of a ball thrown by the apparatus. To avoid this possibility, the wristband 90 uses both the arming button 94 and trigger button 96. The arming button must be manually depressed first, preferably by the quarterback wearing the wristband 90 standing ready and looking toward the device while awaiting a football to be thrown from the apparatus. Then the quarterback must also push the trigger button before the football is launched from the apparatus. Operation of the control with the use of both buttons 94 and 96 for this desirable purpose is described in more detail below with reference to FIG. 9.

When the switches operated by buttons 94, 96 are closed, the transmitter emits a command signal, preferable a radio frequency signal or in the infrared spectrum, although the signal may be electromagnetic or microwave.

Figure 7:
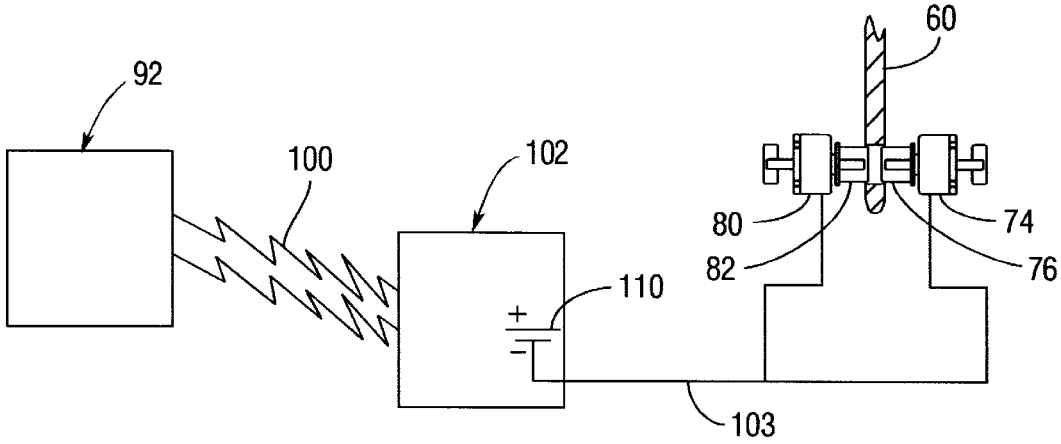
FIG. 7 is a schematic diagram of a controller and latching mechanism.

Referring now to FIG. 7 for a general description of the remote triggering mechanism, a command signal 100 produced by transmitter module 92 is transmitted to a controller 102 having a receiver and an electric power source 110. The controller 102 is supported on the base 10, preferably at module 16 and faces the rear of the apparatus where the player is positioned to receive the football thrown by the apparatus. While the solenoids 74, 80 are electrically de-energized, the latch plungers 76, 82, which are continually biased by springs 78, 84 toward engagement with the latch tab 60, engage the throwing arm and hold it in the horizontal, preloaded position preventing the arm 18 from pivoting. The latch plungers 76, 82 are actuated to retract within their respective solenoids 74, 80 and to disengage the latch tab 60 when the solenoids are energized by an actuating signal upon connecting the electric power source 110 through the controller 102 to the solenoids. The actuating signal may be the electric current carried on line 103 from the controller to the windings of the solenoids 74, 80.

Figure 8:
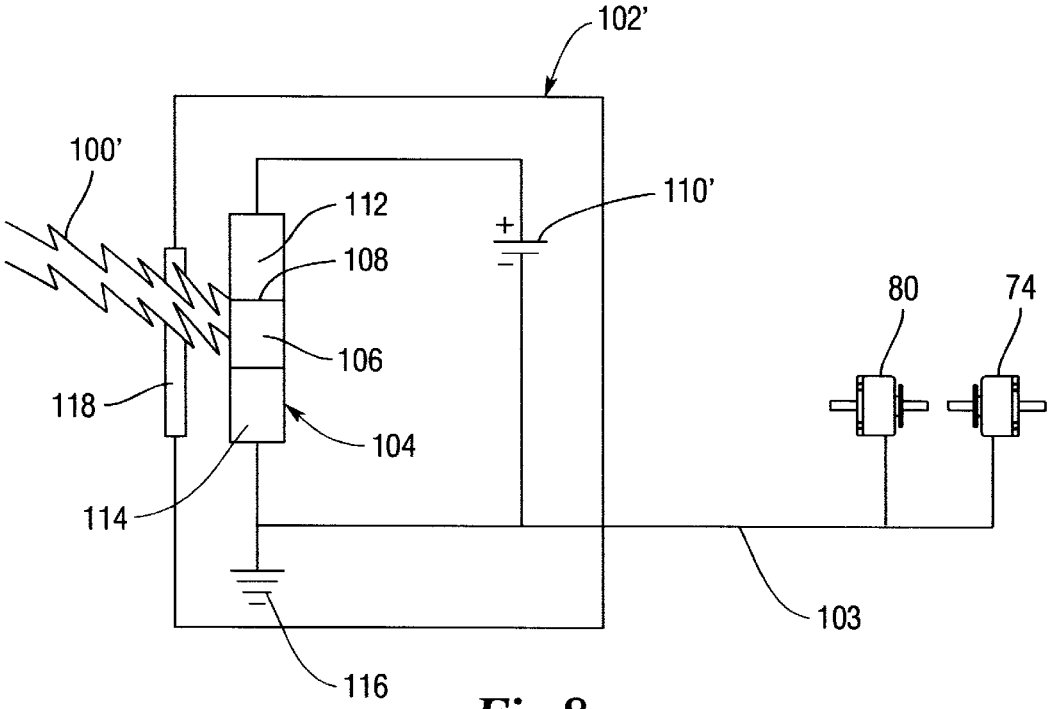
FIG. 8 is a schematic diagram of an infrared controller and circuit for operating the latch.

Focusing now on FIG. 8, controller 102' using an infrared signal includes a switching device, such as an n-p-n phototransistor 104 connected in a common-emitter configuration with the base 106 open. An infrared signal, represented by the command signal 100' produced by transmitter module 92 and received by the controller 102', is concentrated on the region near the collector junction 108. The controller 102' includes a positive voltage power source 110' connected between collector 112 and emitter 114, which is connected to ground 116. The collector junction 108 receives the command signal 100' preferably through a lens 118 supported in a housing enclosing the controller 102'. The phototransistor 104 operates as a switch, which connects the power source 110' to the solenoids 74, 80 when the collector junction is excited by radiation, the command signal 100'.

The phototransistor 104 can be replaced by a photodiode that responds to the command signal to close the circuit and to connect the power source 110' and solenoids. Preferable the controller 102' includes a filter that prevents the phototransistor or photodiode from responding to any command signal produced by a transmitter other than the transmitter module 92 and excludes radiation from sunlight, artificial light, heat and other sources of radiation.

Figure 9:
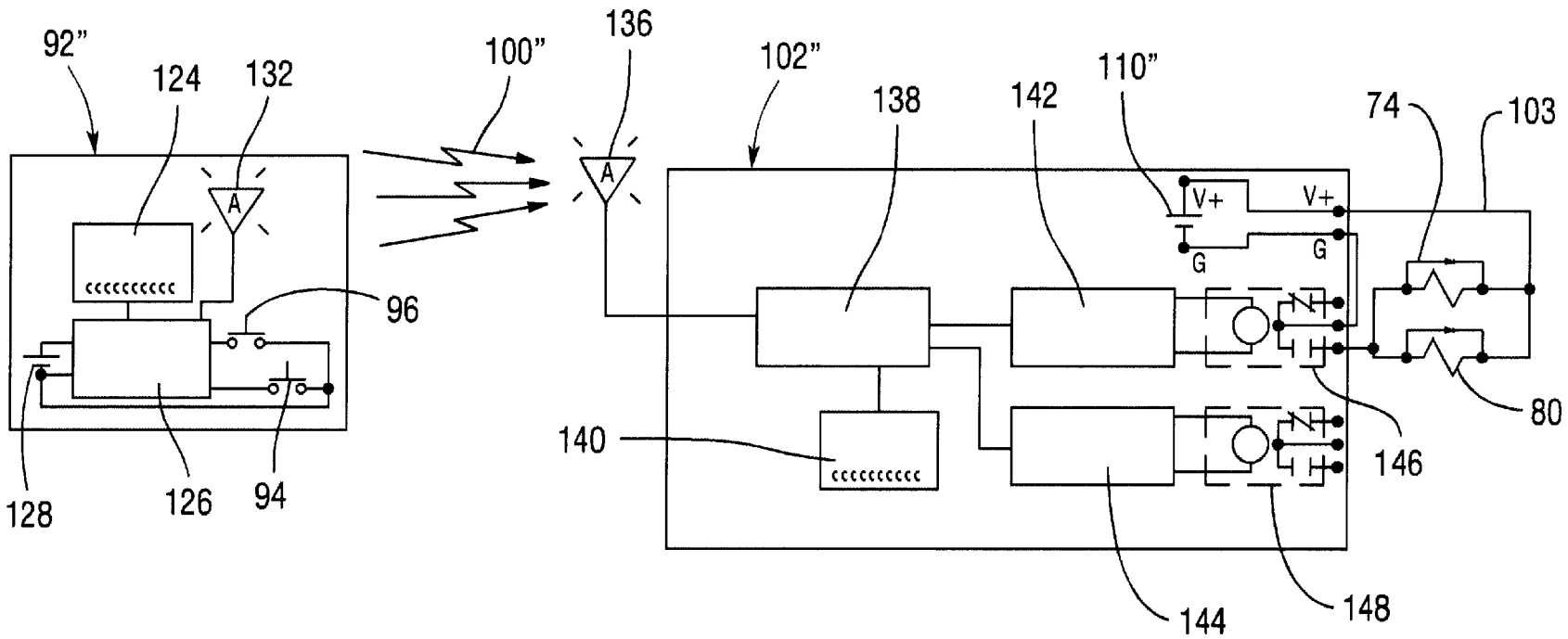
FIG. 9 is a schematic diagram of a radio frequency (RF) transmitter, RF receiver and relay for operating the latch.

FIG. 9 shows the preferred alternative RF control arrangement in which the transmitter module 92" contains an RF output transmitter, and the controller 102 located on the base 10 is a RF controller 102". More specifically, the transmitter module 92" includes an RF transmit channel selector 124, and an RF output transmitter unit 126, which produces an output signal whose frequency is preferably 433.92 MHz. The switch operated by arming button 94 remains closed after button 94 is depressed manually, and it opens again when the trigger button 96 releases after being depressed. The switch controlled by trigger button 96 is depressed manually; thereafter, it immediately releases. When the switches operated by the arming button 94 and trigger button 96 are concurrently closed, a circuit containing an electric power source 128 is closed, and an RF command signal 100" is transmitted via antenna 132.

The RF controller 102" includes an antenna 136, RF amplifier 138, an adjustable RF channel selector 140, first and second channel output drivers 142, 144, relays 146, 148, power source 110", and a circuit for connecting and disconnecting the power source to the windings of solenoids 74, 80 in response to the command signal 100" produced by manual operation of the arming and trigger buttons 94, 96, respectively. Channel selector 140 directs the amplified command signal produced by amplifier 138 to either of the output drivers 142, 144 depending on which of the channel drivers is being used. If the apparatus is used in a game, each team will use a different channel to prevent premature triggering. FIG. 9 shows solenoids 74, 80 connected only to relay 146, which is associated with channel output driver 142. But if the second channel driver 144 is used, the solenoids can be connected instead to relay 148.

The positive voltage terminal is shown continually connected to solenoids 74, 80 and to a normally open terminal of relay 146. A center terminal of relay 146 is continually connected to ground and to the negative terminal of the power source 100". The normally closed terminal of relay 146 is disconnected from the circuit. Therefore, when the command signal 134 is transmitted, amplifier 138 produces a signal received at driver 142, and relay 146 responds to that signal by closing the circuit that includes the power source 100" and solenoids 74, 80. In this way the solenoids 74, 80 withdraw the latch plungers 76, 82 from engagement with latch tab 60, and the throwing arm 18 is released to pivot due to the force of the elastic member 36 and to throw the football to the player.

The force developed by each compression spring 78, 84, which urges the latch plunger into engagement with the latch tab, is approximately 0.75 lb., and the force developed by each solenoid 74, 80, which retracts the latch plunger and disengages the plunger from the tab, is greater than the force of the spring and is approximately 1.0 lb.

In operation, the device is prepared by first removing the safety storage pin 56. Preferably the keypad is then used to enter the length in seconds of a short period (approximately 4 to 8 seconds) that begins when the trigger button 96 is depressed and ends with an audio alarm to indicate the maximum time the quarterback has to throw the football as described in more detail in U.S. Pat. No. 6,424,598. The flexible elastic member 36 is connected to the throwing arm 18 at 34 and to the base 10 at 30. Then the arm is pivoted from the released, substantially vertical position to the preloaded, horizontal position where the latch plunger 76, 82 engage the latch tab 60 and holds the arm stationary.

Next, the football 26 is placed on the cradle 22. When the quarterback is in position and awaiting the ball to be thrown, he manually depresses the arming button 94 on the wristband 90. The switch in the transmitter module 92 operated by button 94 closes and remains closed, but the transmitter circuit remains open because the other switch in the transmitter circuit, controlled by trigger button 96, remains open. Finally the player manually depresses the trigger button 96, which closes the transmitter circuit and causes the command signal to issue from the transmitter, and both the switches controlled by buttons 94 and 96 open immediately. The command signal is received at the receiver controller located on the base 10. The command signal is used to actuate the solenoids 74, 80 to release the latch plunger 76, 82 from the latch tab 60, and the arm 18 is released to pivot and throw the ball to the player due to the force of the preloaded elastic member 36.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. An apparatus for throwing an object, comprising:

a pivotally mounted arm supporting the object, the arm having a preloaded position at which the arm is elastically biased to eject the object from the apparatus;

a latch continually tending to engage and hold the arm in the preloaded position and able to disengage and release the arm from the preloaded position;

a transmitter producing a command signal; and a controller having a receiver adapted to receive the command signal and to produce in response to the command signal an actuation signal that disengages the latch and releases the arm.

2. The apparatus of claim 1, further comprising:

an elastic member contacting the arm producing the elastically bias force applied to the arm in the preloaded position, the force tending to pivot the arm and throw the object.

3. The apparatus of claim 2, wherein the transmitter produces the command signal that is selected from a group consisting of an infrared signal, a radio frequency signal, a microwave signal, and an electromagnetic signal.

4. The apparatus of claim 2, wherein a magnitude of a force produced by the elastic member can be varied by an adjustment mechanism.

5. The apparatus of claim 2, further comprising:

a base including a pivot pin on which the arm is mounted, and a first connection located at a first lateral side of the pivot pin; and a second connection located on the arm at a lateral side of the pivot pin opposite the location of the first connection and spaced from the first connection, wherein the elastic member is resiliently secured to the first connection and second connection, biasing the arm to pivot on the pivot pin when the arm is in said preloaded position.

6. The apparatus of claim 5, wherein the transmitter is portable.

7. The apparatus of claim 6, wherein the controller further comprises:

a source of electric power;

a receiver for receiving said command signal; and a switch responsive to the command signal for connecting the electric power source and solenoid.

8. The apparatus of claim 6, wherein the transmitter produces an infrared command signal, and the controller further comprises:

a source of electric power; and a phototransistor having a collector junction where the infrared signal is received and concentrated, the phototransistor electrically connecting the electric power source and solenoid when the command signal is received in a region near the collector junction.

9. The apparatus of claim 6, wherein the transmitter produces a radio frequency command signal, and the controller further comprises:

a source of electric power; and a relay adapted alternately to connect the electric power source and solenoid in response to the presence of the command signal and to disconnect the electric power source and solenoid in response to the absence of the command signal.

10. The apparatus of claim 1, wherein the transmitter produces the command signal in response to manual actuation of a triggering mechanism on the transmitter.

11. The apparatus of claim 1, wherein the latch further comprises:

a latch tab secured to the arm;

a spring;

a latch plunger located adjacent the latch tab, biased by the spring into engagement with the latch tab when the arm is in the preloaded condition; and a solenoid for disengaging the latch plunger from the latch tab in response to the actuation signal.

12. An apparatus for throwing an object in an airborne path, comprising:

a base including a first connection;

a pivot pin supported on the base;

an arm pivotally mounted on the pivot pin, the arm including a second connection located at a second lateral side of the pivot pin opposite the location of the first connection and spaced from the first connection, the arm having a preloaded position;

an elastic member secured to the base at the first connection and secured to the arm at the second connection, the elastic member producing an elastic force tending to elastically load the arm when the arm is in the preloaded position;

a latch continually tending to engage and hold the arm in the preloaded position and able to disengage and release the arm from the preloaded position;

a transmitter producing a command signal; and a controller having a receiver adapted to receive the command signal and produce in response to the command signal an actuation signal that disengages the latch and releases the arm.

13. The apparatus of claim 12, wherein a magnitude of the elastic force produced by the elastic member can be varied by an adjustment mechanism.

14. The apparatus of claim 12, wherein:

the arm further comprises a first securing member;

the base further comprises a second securing member aligned with the first securing member when the arm is pivoted to a stowed position; and an attachment engaged with the first and second securing members for releasably holding the arm in position relative to the base when the arm is in the stowed position.

15. The apparatus of claim 12, wherein the base further comprises a first chamber, and the latch further comprises:

a latch tab secured to the arm and being moveable adjacent to the chamber;

a spring located in the chamber;

a latch plunger located in the chamber, biased by the spring toward engagement with the latch tab when the arm is in the preloaded position; and a solenoid located in the chamber for disengaging the latch plunger from the latch tab in response to the actuation signal.

16. The apparatus of claim 12, wherein the base further comprises a first chamber and a second chamber spaced from the first chamber, and the latch further comprises:

a latch tab secured to the arm, and the latch tab being moveable between and adjacent to the first and second chambers;

a first spring located in the first chamber;

a second spring located in the second chamber;

a first latch plunger located in the first chamber, biased by the first spring toward engagement with the latch tab when the arm is in the preloaded position;

a second latch plunger located in the second chamber, biased by the second spring toward engagement with the latch tab when the arm is in the preloaded position;

a first solenoid located in the first chamber for disengaging the first latch plunger from the latch tab in response to the actuation signal; and a second solenoid located in the second chamber for disengaging the second latch plunger from the latch tab in response to the actuation signal.

17. The apparatus of claim 12, wherein the transmitter produces the command signal in response to manual actuation of a button on the transmitter.

18. The apparatus of claim 12, wherein the latch further comprises:

a latch tab secured to the arm;

a spring;

a latch plunger located adjacent the latch tab, the latch plunger being biased by the spring into engagement with the latch tab when the arm is in the preloaded position; and a solenoid for disengaging the latch plunger from the latch tab in response to the actuation signal.

19. The apparatus of claim 18, wherein the controller further comprises:

a source of electric power; and a switch responsive to the command signal for connecting the electric power source and solenoid.

20. The apparatus of claim 18, wherein the transmitter produces an infrared command signal, and the controller further comprises:

a source of electric power; and a phototransistor having a collector junction where the infrared signal is received and concentrated, the phototransistor electrically connecting the electric power source and solenoid when the command signal is received in a region near the collector junction.

21. The apparatus of claim 18, wherein the transmitter produces a radio frequency command signal, and the controller further comprises:

a source of electric power; and a relay adapted alternately to connect the electric power source and solenoid in response to the presence of the command signal and to disconnect the electric power source and solenoid in response to the absence of the command signal.

* * * * *